United States Patent [19]

Cashman

[11] 4,103,502

[45] Aug. 1, 1978

[54] PRODUCTION OF ARTIFICIAL ISLANDS

[75] Inventor: Patrick Michael Cashman, London, England

[73] Assignee: Sykes Construction Services Limited, London, England

[21] Appl. No.: 803,252

[22] Filed: Jun. 3, 1977

[30] Foreign Application Priority Data

Jun. 9, 1976 [GB] United Kingdom ..... 23930/76

[51] Int. Cl.[2] ..... E02D 21/00; E02B 1/00

[52] U.S. Cl. ..... 61/86; 61/30; 61/50

[58] Field of Search ..... 61/86, 50, 52, 1, 11, 61/35, 30

[56] References Cited

U.S. PATENT DOCUMENTS

| | | | |
|---|---|---|---|
| 3,798,912 | 3/1974 | Best et al. | 61/1 R |
| 3,938,342 | 2/1976 | Aubert | 61/50 X |
| 4,009,580 | 3/1977 | Dowse | 61/50 |

*Primary Examiner*—Jacob Shapiro

*Attorney, Agent, or Firm*—McAulay, Fields, Fisher & Goldstein

[57] ABSTRACT

In a method of constructing an artificial island wherein an envelope or membrane is filled with sand or other permeable material and during filling water is removed from the body of deposited material by suction, drainage of water from the deposited material is improved by the provision of at least one drainage tube which extends downwardly through the body of material and contains perforations along its length through which water may drain to a drainage layer at the base of the island and in communication with a suction pipe. To prevent water being drawn into the part of the drainage tube above the level of the deposited material the pipe is closed by a closure means which is moved upwardly as the level of deposited material rises. There is also described an artificial island formed by the improved method.

10 Claims, 6 Drawing Figures

PRODUCTION OF ARTIFICIAL ISLANDS

BACKGROUND OF THE INVENTION

This invention relates to the construction of artificial islands.

Artificial islands have various uses, for example in supporting drilling platforms in oil-exploration and extraction, as foundations for lighthouses, and as copper-dams or breakwaters. However, the cost of constructing such islands by depositing naturally-occurring materials can be extremely high because of the massive quantities of material which are required. The underwater angle of repose of most natural materials is extremely low, and there is also the problem of the scouring action of water which may not only erode the island but also lead to silting in nearby areas. Thus, it can be unacceptably costly to construct artificial islands except in areas of shallow and still water and, of course, islands are usually required in other locations.

It has recently been proposed to construct an artificial island by containing a sandy or other permeable material in an envelope or membrane of robust plastics material, and applying suction to the interior of the membrane to extract water and to reduce pressure in the membrane. Thus, the hydrostatic pressure of the surrounding water acts to rigidify the contained sand from which water has been extracted. Preliminary tests on these so-called "sand-islands" have given promising results, but difficulties can arise during placing of the sand in the membrane which is initially filled with water, as the sand tends to spread excessively before the angle of repose can be increased by water extraction and pressure reduction. In order to overcome these difficulties, which increase with the diameter of the membrane, water is drained from the sand and extracted from the membrane during sand filling. The water may be extracted through a central pipe or wellscreen and, to promote drainage flow to the pipe, vertically spaced layers of relatively coarse sand are introduced to provide generally horizontal drainage layers. Needless to say, the provision of these drainage layers, which are difficult to position accurately, increases the complexity and expense involved in producing the island.

It is an object of the present invention to provide an improved method of constructing sand islands, in which the aforementioned difficulties are reduced.

SUMMARY OF THE INVENTION

In accordance with the present invention there is provided a method of constructing an artificial island in which sand or other permeable material is placed in a flexible envelope and suction is applied to the interior of the envelope to extract water and reduce pressure whereby the hydrostatic pressure of the surrounding water acts to rigidify the material in the envelope, characterised in that relatively coarse material is introduced initially to form a drainage layer at the bottom of the envelope, at least one extraction and suction pipe is introduced to extend downwardly towards the bottom drainage layer, and at least one drainage tube is introduced to extend downwardly to the bottom drainage layer, the drainage tube having perforations along its length, and closure means are moved upwardly along said tube during material filling to connect said perforations in succession with said bottom drainage layer from which water is extracted.

Suitably, a series of drainage tubes are arranged around at least one suction and extraction pipe.

Preferably, the or each drainage tube comprises alternate imperforate and perforated lengths, and said closure means comprises an inflatable plug which is axially movable within the tube. In most cases, the drainage tubes and extraction pipes are left in position after completion of the island, and the extraction pipe is maintained under continuous or at least intermittent drawdown conditions during the life of the island; in further accordance with the present invention, there is provided an artificial island comprising a flexible envelope filled with sand or like permeable material, a deck at the mouth of the bag and supported by said material, and at least one extraction and suction pipe extending downwardly from the decks towards the bottom of the envelope, characterised in that a drainage layer of relatively coarse material is provided at the bottom of the envelope, said pipe extends to said layer, and at least one perforated drainage tube extends downwardly towards said drainage layer.

REFERENCE TO PRIOR ART

Figure 1:
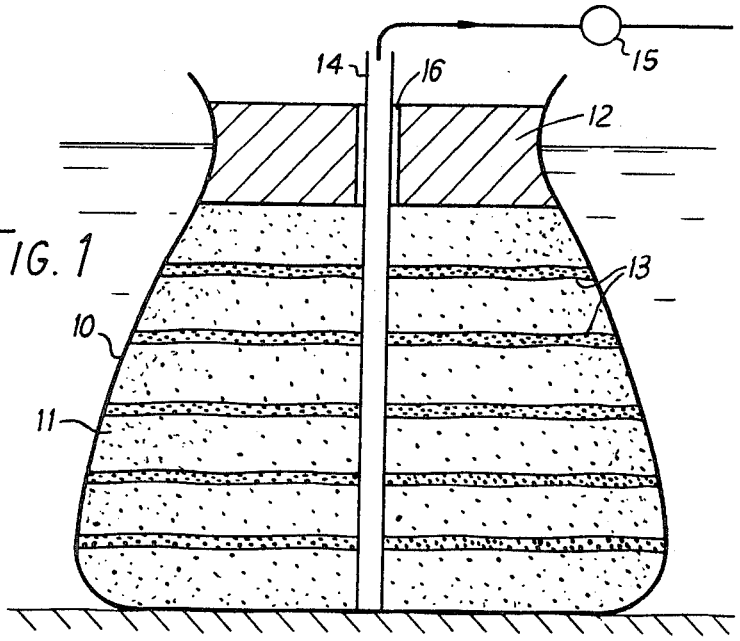
FIG. 1 is a diagrammatic vertical section through a completed sand island constructed according to a prior proposal.

Referring to FIG. 1 of the drawings, the completed sand island comprises a stout envelope or membrane 10 of synthetic rubber or plastics material, filled with sand 11 and supporting a buoyant deck unit 12 which is secured in the mouth of the membrane. The sand filling may include a series of horizontal layers 13 of coarse sand which drain to a perforated central pipe 14, and a suction pump 15 is connected to the pipe 14. Sand is introduced into the membrane through annular passageway 16, between the pipe and the deck, and the pump 15 operates during placing of the sand to extract the water which initially fills the membrane. The pump operation is continued after the membrane has been sand-filled, to reduce pressure in the membrane so that the external hydrostatic pressure acts to rigidify the sand filling from which most of the water has been extracted. The layers 13 allow water to drain to the pipe 14 during the sand-filling operation and, subsequently, allow drainage of residual or leakage water and also increase the exposure of the sand body to the suction effect of the pumping.

It will be appreciated that the provision of the drainage layers 13 involves the inconvenience of the controlled supply of two grades of sand, and it is difficult to ensure that the layers are horizontal as the introduced sand tends to assume a conical form around the pipe 14. Furthermore, the layers 13 tend to become blocked with finer sand after a period of time.

DESCRIPTION OF PREFERRED EMBODIMENTS OF THE INVENTION

Figure 2:
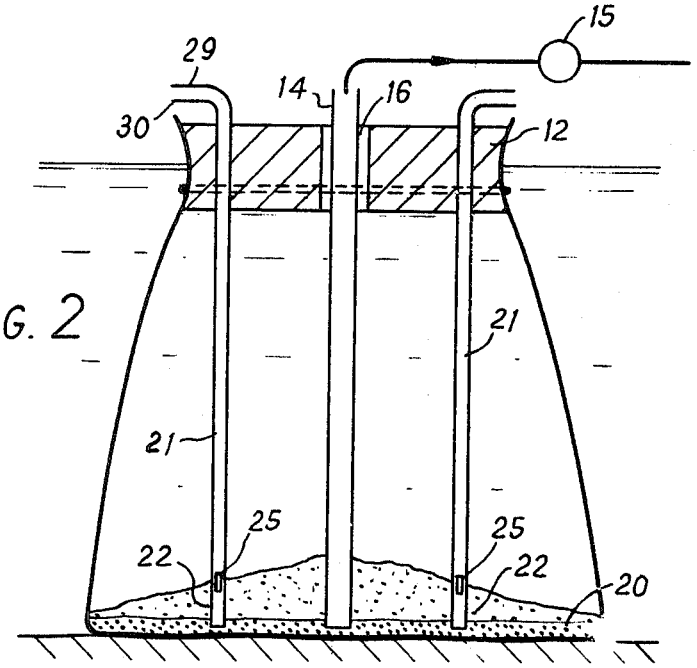
FIG. 2 is a diagrammatic vertical section through a sand island according to the present invention, in an early stage of construction.
Figure 3:
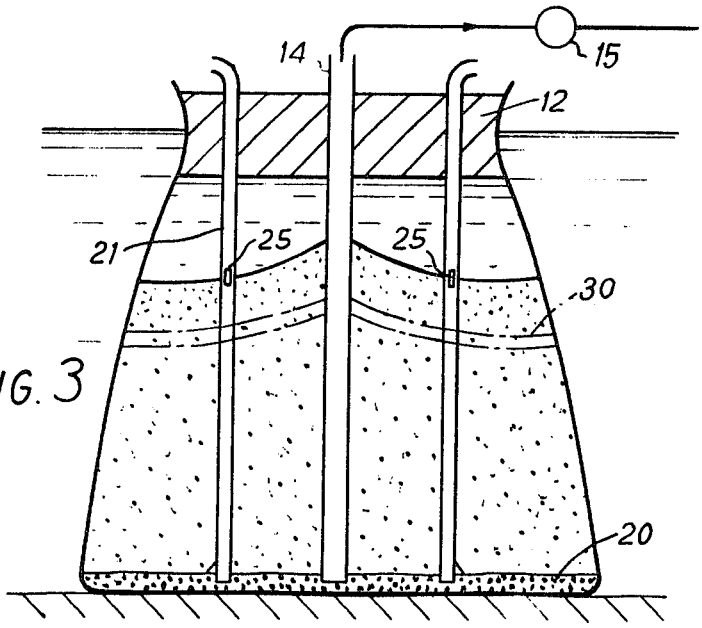
FIG. 3 is a section corresponding to FIG. 2, but showing the island in a later stage of construction.

Referring now to FIGS. 2 and 3, the sand island is of similar construction to that illustrated in FIG. 1, but only a base layer 20 of coarse sand is provided. Also, a series of, say, eight upright drainage tubes 21 are arranged symmetrically around the central pipe 14. The tubes extend through the deck 12 down to the drainage layer 20 and may be anchored to connectors 22 secured at the bottom of the membrane; the tubes 21 may be splayed outwardly to drain water from the area near the membrane.

Figure 4:
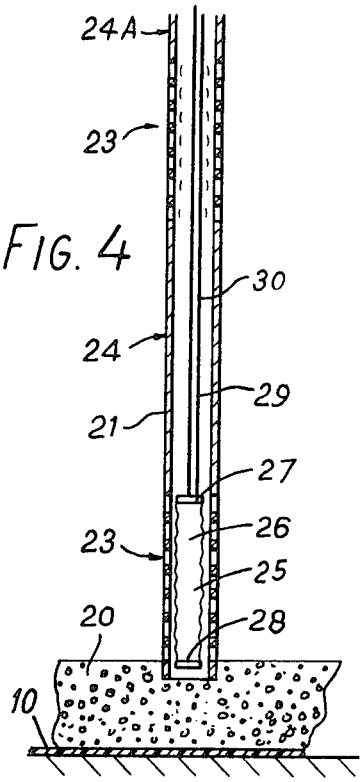
FIGS. 4 and 5 are detail sections illustrating a drainage tube and its movable plug, as shown in FIGS. 2 and 3.

As best shown in FIG. 4, each tube 21 is formed with alternate perforated and imperforate lengths 23 and 24, and a movable plug 25 is located in each tube. The dimensions of the tubes 21 will vary according to individual requirements but, in one example, the tubes are of 6 inches diameter and about 50 feet long, with perforated and imperforate lengths of about one meter.

Figure 5:
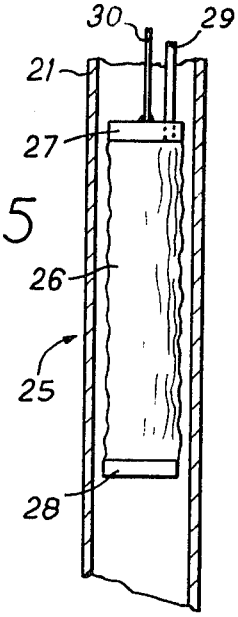

The plug 25 (FIG. 5) comprises an inflatable sleeve 26 extending between end plates 27, 28. An air pipe 29 extends to the sleeve 26 through the upper plate 27 which is secured to a cable 30.

In the construction of the island illustrated in FIGS. 2 and 3, the buoyant raft or deck unit is towed out to the site, as is the envelope 10 which is formed from reinforced synthetic rubber. The envelope may then be floated out to the deck unit and the mouth of the envelope is secured around the deck unit by means of cables provided with tensioners. Coarse sand is fed into the water-filled membrane through passageway 16 to form base layer 20, and the pipe 14 and tubes 21 are introduced and positioned, possibly by divers. Finer sand 11 which forms the body of the island is then fed through passageway 16 to build up the body of the island. As the deposited sand 11 which is topped by a variable layer of "quicksand," builds up and covers the layer 20, water is extracted through pipe 14 so that the water contained firstly in the drainage layer 20, and then in the deposited sand 11 shown in FIG. 2, is drained off. The plugs 25 in the positions shown in tubes 21 prevent water above the deposited sand 11 from draining downwardly to the layer 20.

When the deposited sand 11 has risen to reach the first imperforate length 24 of each tube, the plug is deflated and raised to the position of the second perforated length 23A where it is reflated to close that length. Water from the deposited sand 11 may then drain through the perforations in the first length 23 downwardly to the drainage layer 20 where it passes inwardly to be extracted through the pipe 14. The tubes 21 then operate as vertical reverse relief well screens, and it will be appreciated that the plugs 25 again block the tubes 21 to prevent water above the deposited sand 11 from draining directly to the layer 20. As the body of sand 11 continues to rise, the plugs are raised step-by-step and through the positions shown in FIG. 3, until the sand placing has been completed, and the deck may be floated up to promote filling of the envelope.

As a result of the above process, water is drained from the body of sand 11 as the body is built up, without the necessity of providing horizontal drainage layers such as 13 in FIG. 1. After completion of the island, the drainage tubes 21 may be extracted for further use or may be left in position with the plugs removed, so that they continue to promote drainage to the pipe 14 which is maintained permanently under suction conditions.

Although horizontal drainage layers should not be essential when the tubes 21 are employed, it may be decided to introduce a small number of such layers to promote the sand drainage process even further. In this case, however, there is no necessity for the layers to be precisely horizontal and, indeed, the flow may be improved if the layers slope downwardly, as indicated at 30 in FIG. 3, to meet the drainage tubes 21. Particularly in such a case, the tubes 21 may be splayed outwardly to drain water from the areas near the membrane, as already referred to above.

In a further modification, the drainage tubes 21 are perforated along their entire lengths, and the plugs 25 are raised so as to be positioned at or just below the top surface of the deposited sand 11.

Figure 6:
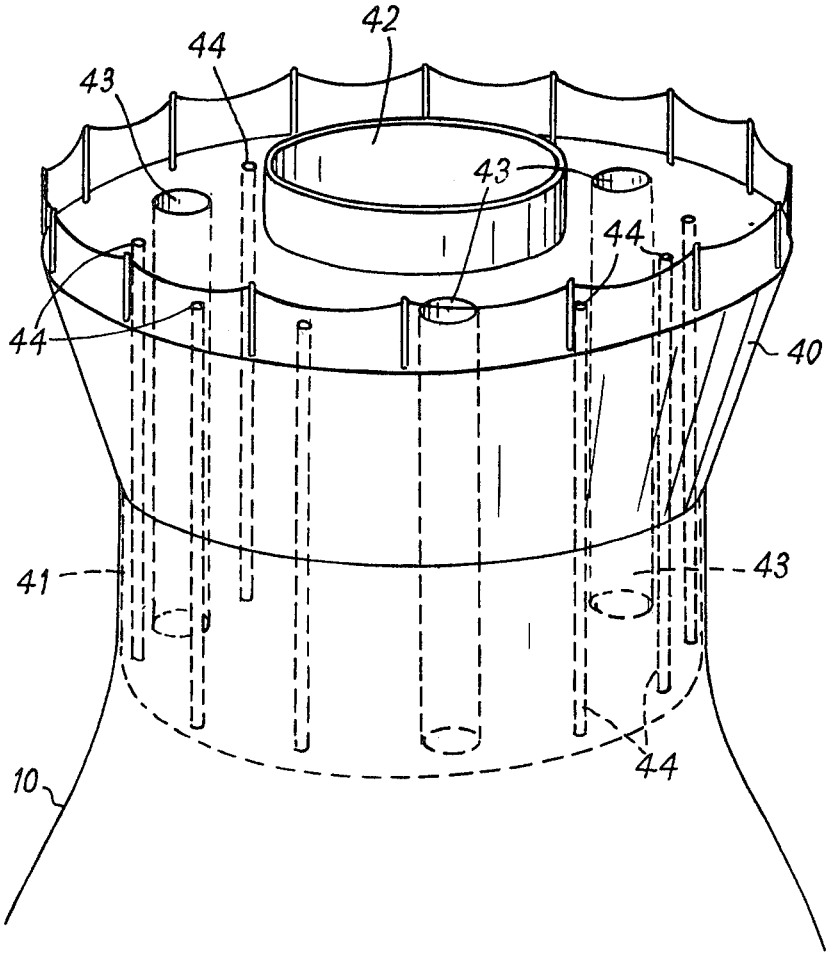
FIG. 6 is a perspective view illustrating a deck unit shown diagrammatically in FIGS. 2 and 3.

In the embodiments described above, the deck unit 12 is, for convenience, shown simply as a plug-like part but FIG. 6 illustrates one form of unit which has proved successful in initial trials. In FIG. 6, the deck unit comprises an upper part 40 having compartments which house instrumentation, power generators, etc., and a lower part 41 formed as water tanks for buoyancy and trim control. A central hopper 42 to contain gravel, extends through the two parts of the deck unit and is provided with a hinged trap door at its base (not shown). A series of three suction pipes 43 are arranged symmetrically around the hopper and nine drainage or relief tubes 44 are arranged around the pipes 43. After completion of an island having such a deck unit, a shaft can be sunk into the sea bed by drilling centrally downwardly through the sand and the bottom of the envelope which is at this stage pressed firmly against the bed of the sea or waterway.

I claim:

1. In a method of constructing an artificial island in which sand or other permeable material is placed in a flexible envelope and suction is applied to the interior of the envelope to extract water and reduce pressure whereby the hydrostatic pressure of the surrounding water acts to rigidify the material in the envelope, the improvement wherein relatively coarse material is introduced initially to form a drainage layer at the bottom of the envelope, at least one extraction and suction pipe is introduced to extend downwardly to the bottom drainage layer, and at least one drainage tube is introduced to extend downwardly towards the bottom drainage layer, the drainage tube has perforations along its length, and closure means are moved upwardly along said tube during material filling to connect said perforations in succession with said bottom drainage layer from which water is extracted.

2. The method claimed in claim 1, wherein a series of said drainage tubes are arranged around at least one suction and extraction pipe.

3. The method as claimed in claim 1, wherein said closure means comprises an inflatable plug axially movable within the drainage tube, said plug is inflated to seal said tube, and is deflated prior to each upward movement to a new sealing position.

4. The method claimed in claim 3, wherein said drainage tube comprises alternate imperforate and perforated lengths, and said plug is located in an imperforate length when inflated for sealing of said tube.

5. In an artificial island comprising a flexible envelope filled with sand or like permeable material, a deck at the mouth of the bag and supported by said material, and at least one extraction and suction pipe extending downwardly from the deck towards the bottom of the envelope, the improvement wherein a drainage layer of relatively coarse material is provided at the bottom of the envelope, said pipe extends to and opens to said layer, and at least one perforated drainage tube extends downwardly towards said drainage layer.

6. The artificial island as claimed in claim 5, including closure means axially movable within said drainage tube, said closure means being inflatable to seal said tube and deflatable to open said tube.

7. The artificial island as claimed in claim 5, wherein said drainage tube comprises alternate imperforate and perforated lengths, said closure means when inflated being effective to seal said drainage tube to prevent water above the permeable material from draining downwardly towards the drainage layer.

8. The artificial island as claimed in claim 5, wherein said pipe and said tube are separated from each other, said pipe being imperforate and opening at its pipe inlet into said drainage layer, said tube operating as vertical relief well screens to permit water to drain through said drainage tube to the drainage layer where it passes into said pipe for extraction.

9. The artificial island as claimed in claim 8, wherein said tube is perforated along its length, and including an inflatable plug movable within the interior of said tube axially thereof, said plug when inflated being effective to seal said drainage tube to prevent liquid above the permeable material from draining downwardly into the drainage layer.

10. The artificial island as claimed in claim 5, wherein said deck unit comprises an upper part for housing instrumentation and a lower part, formed as water tanks for buoyancy and trim control, and a central hopper extending through said upper and said lower parts; and at least two of said suction pipes and said drainage pipes arranged symmetrically around said hopper.

* * * * *